US009368271B2

(12) United States Patent
Li et al.

(10) Patent No.: US 9,368,271 B2
(45) Date of Patent: Jun. 14, 2016

(54) THREE-DIMENSION SYMMETRICAL VERTICAL TRANSFORMER

(71) Applicant: Industrial Technology Research Institute, Hsinchu (TW)

(72) Inventors: Sih-Han Li, New Taipei (TW); Chih-Sheng Lin, Tainan (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 14/693,866

(22) Filed: Apr. 22, 2015

(65) Prior Publication Data

US 2016/0012958 A1 Jan. 14, 2016

Related U.S. Application Data

(60) Provisional application No. 62/022,205, filed on Jul. 9, 2014.

(30) Foreign Application Priority Data

Sep. 9, 2014 (TW) ..... 103130990 A

(51) Int. Cl.
*H01F 5/00* (2006.01)
*H01F 27/28* (2006.01)
*H01F 27/29* (2006.01)

(52) U.S. Cl.
CPC ..... *H01F 27/2804* (2013.01); *H01F 5/00* (2013.01); *H01F 27/2823* (2013.01); *H01F 27/29* (2013.01); *H01F 2027/2809* (2013.01)

(58) Field of Classification Search
CPC ..... H01F 5/00; H01F 27/00–27/30
USPC ..... 336/65, 200, 206–208, 192, 232
See application file for complete search history.

(56) References Cited

U.S. PATENT DOCUMENTS 4,313,152 A * 1/1982 Vranken ..... H01F 5/003 336/200
6,480,086 B1 11/2002 Kluge et al.

(Continued)

FOREIGN PATENT DOCUMENTS

CN 102969304 3/2013
TW I408796 9/2013

OTHER PUBLICATIONS

"Office Action of Europe Counterpart Application", issued on Dec. 21, 2015, p. 1-p. 9.

(Continued)

*Primary Examiner* — Tuyen Nguyen
(74) *Attorney, Agent, or Firm* — Jianq Chyun IP Office

(57) ABSTRACT

First and second paths of the primary-coil of the transformer are located at different sides of the symmetry-line. First terminals of the first and second paths are first and second ports of the primary-coil. Second terminals of the first and second paths are connected to each other. Two partial paths of the first path are connected to each other by TSV. Two partial paths of the second path are connected to each other by TSV. Third and fourth paths of the secondary-coil of the transformer are located on different sides of the symmetry-line. First terminals of the third and fourth paths are first and second ports of the secondary-coil. Second terminals of the third and fourth paths are connected to each other. Two partial paths of the third path are connected to each other by TSV. Two partial paths of the fourth path are connected to each other by TSV.

12 Claims, 5 Drawing Sheets

(56) References Cited

U.S. PATENT DOCUMENTS

| | | | | |
|---|---|---|---|---|
| 6,661,325 | B2 * | 12/2003 | Suh | H01F 17/0013 336/192 |
| 6,927,664 | B2 * | 8/2005 | Nakatani | H01P 5/10 336/200 |
| 7,511,588 | B2 * | 3/2009 | Gabara | G06F 1/10 331/117 FE |
| 8,471,358 | B2 | 6/2013 | Yen et al. | |
| 8,610,247 | B2 | 12/2013 | Yen et al. | |
| 2008/0272875 | A1 | 11/2008 | Huang et al. | |
| 2011/0140825 | A1 | 6/2011 | Kim et al. | |
| 2012/0056680 | A1 | 3/2012 | Kim et al. | |
| 2013/0020675 | A1 | 1/2013 | Kireev et al. | |
| 2013/0168809 | A1 | 7/2013 | Yen et al. | |
| 2013/0181534 | A1 | 7/2013 | Jin et al. | |
| 2013/0307656 | A1 | 11/2013 | Carpenter et al. | |

OTHER PUBLICATIONS

Zhang et al., "3D TSV Transformer Design for DC-DC/AC-DC Converter," 2010 Electronic Components and Technology Conference, Jun. 1-4, 2010, pp. 1653-1656.

Peng et al., "A Simple Low Cost Monolithic Transformer for High-Voltage Gate Driver Applications," IEEE Electron Device Letters, Jan. 2014, pp. 108-110.

Feng et al., "High-Performance Solenoidal RF Transformers on High-Resistivity Silicon Substrates for 3D Integrated Circuits," IEEE Transactions on Microwave Theory and Techniques, Jul. 2012, pp. 2066-2072.

Lim et al., "Fully Symmetrical Monolithic Transformer (True 1 : 1) for Silicon RFIC," IEEE Transactions on Microwave Theory and Techniques, Oct. 2008, pp. 2301-2311.

Tseng et al., "Design Considerations for Radio Frequency 3DICs," 2012 IEEE Electrical Design of Advanced Packaging and Systems Symposium, Dec. 9-11, 2012, pp. 197-200.

Duplessis et al, "Physical Implementation of 3D Integrated Solenoids within Silicon Substrate for Hybrid IC Applications," Proceedings of the 39th European Microwave Conference, Sep. 29, 2009-Oct. 1, 2009, pp. 1006-1009.

Takemura et al., "Si Interposers with 15-um-thick Spiral Inductors and SrTiO3 Thin Film Capacitors for Novel 3D Stacked Buck Converters," Transactions of Japan Institute of Electronics Packaging, Dec. 2013, pp. 78-86.

Khaled Salah, "A TSV-Based Architecture for AC-DC Converters," 2013 8th International Design and Test Symposium (IDT), Dec. 16-18, 2013, pp. 1-4.

Peng et al., "A Fully Integrated 3D TSV Transformer for High-Voltage Signal Transfer Applications," ECS Solid State Letters, Feb. 9, 2013, pp. Q29-Q31.

* cited by examiner

THREE-DIMENSION SYMMETRICAL VERTICAL TRANSFORMER

CROSS-REFERENCE TO RELATED APPLICATION

This application claims the priority benefits of U.S. provisional application Ser. No. 62/022,205, filed on Jul. 9, 2014 and Taiwan application serial no. 103130990, filed on Sep. 9, 2014. The entirety of each of the above-mentioned patent applications is hereby incorporated by reference herein and made a part of this specification.

TECHNICAL FIELD

The disclosure relates to a three-dimension symmetrical vertical transformer.

BACKGROUND

In an integrated circuit (IC) manufacturing process, various integrated passive devices (IPDs) are implemented in a chip through a front end of line (FEOL). Inductors and transformers are commonly used passive devices in the chip, and are widely applied to various radio frequency (RF) ICs, such as, a low noise amplifier (LNA), a voltage-controlled oscillator (VCO), an injection-locked frequency divider (ILFD), a power amplifier (PA), etc. Although a number of external devices can be reduced by implementing the inductors and transformers in the chip, the passive devices in the chip usually occupy a large chip area, which increases cost of the FEOL.

Packaging technology has been developed from thin small outline packaging (TSOP), chip scale package (CSP), wafer level package (WLP), etc. to stacked package on package (PoP). Design of a semiconductor circuit often encounters a bottleneck, for example, an analog circuit and a digital circuit are not easy to be integrated through a system on chip (SoC) process, or even if the analog circuit and the digital circuit are integrated to the SoC, issues of high cost and being unable to achieve characteristic optimisation are encountered. System in package (SiP) can integrate different devices through a packaging technique. However, when packaging requirements become more complicated, the SiP technique also has a design bottleneck related to operation speed, power consumption, size, etc.

A three-dimension integrated circuit (3DIC) technique can effectively increase product performance, reduce power consumption, cost, volume and integrate heterogeneous ICs. The 3DIC technique can be regarded as another solution of the SoC and SiP techniques. According to the 3DIC technique, chips with different functional properties or even different substrates can be respectively manufactured through most suitable manufacturing processes thereof, and then a through silicon via (TSV) technique is used to implement 3D stacking for integration. The 3DIC technique is not only capable of reducing a length of a metal wire and reducing a wiring resistance, but is also capable of reducing a chip area, and has small volume, high integration, high efficiency, low power consumption and low cost. Before the 3D stacking is performed, fabrication of circuit or system of different chip layers is generally completed through the most suitable FEOL (the IC manufacturing process). After fabrication of the different chip layers is completed, the different chip layers are stacked to each other through TSV, bumps and re-distributed layer (RDL) to implement a stacking step of a back end of line (BEOL) (the packaging process). By implementing various IPDs through the BEOL, not only is a BEOL area effectively used, the IPDs originally implemented in the FEOL is changed to be implemented in the BEOL. By implementing the IPDs through the BEOL, the area of the expensive FEOL is saved to achieve an effect of cost reduction.

Besides consideration of area, there is still a technical issue related to noise. In order reduce a common mode noise, a circuit structure is generally designed to a differential type to increase a differential gain and suppress a common mode noise gain. In this way, the IPDs usually place emphasis on a symmetrical structure to cope with a demand of the differential type. If a transformer adopts the differential type, the symmetrical structure thereof is further emphasized, so as to achieve better differential operation characteristics.

SUMMARY

An embodiment of the disclosure provides a transformer including a primary coil and a secondary coil. The primary coil includes a first electrical path and a second electrical path respectively located at different sides of a symmetry line on a projection plane of the transformer. First terminals of the first electrical path and the second electrical path respectively serve as a first port and a second port of the primary coil. A second terminal of the first electrical path is connected to a second terminal of the second electrical path at the symmetry line. The first electrical path includes a first partial path disposed on a first substrate and a second partial path disposed on a second substrate. The first partial path and the second partial path are connected to each other by at least one through silicon via (TSV). The second electrical path includes a third partial path disposed on the first substrate and a fourth partial path disposed on the second substrate. The third partial path and the fourth partial path are connected to each other by at least one TSV. The secondary coil includes a third electrical path and a fourth electrical path respectively located at different sides of the symmetry line on the projection plane. First terminals of the third electrical path and the fourth electrical path respectively serve as a first port and a second port of the secondary coil. A second terminal of the third electrical path is connected to a second terminal of the fourth electrical path at the symmetry line. The third electrical path includes a fifth partial path disposed on the first substrate and a sixth partial path disposed on the second substrate. The fifth partial path and the sixth partial path are connected to each other by at least one TSV. The fourth electrical path includes a seventh partial path disposed on the first substrate and an eighth partial path disposed on the second substrate. The seventh partial path and the eighth partial path are connected to each other by at least one TSV.

Several exemplary embodiments accompanied with figures are described in detail below to further describe the disclosure in details.

BRIEF DESCRIPTION OF THE DRAWINGS

The accompanying drawings are included to provide further understanding, and are incorporated in and constitute a part of this specification. The drawings illustrate exemplary embodiments and, together with the description, serve to explain the principles of the disclosure.

DETAILED DESCRIPTION OF DISCLOSED EMBODIMENTS

Figure 1:
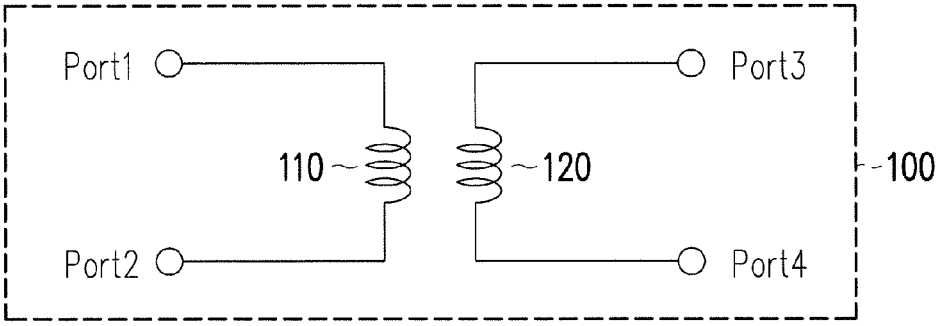
FIG. 1 is a circuit schematic diagram of a transformer according to an embodiment of the disclosure.

A term "couple" used in the full text of the disclosure (including the claims) refers to any direct and indirect connections. For example, if a first device is described to be coupled to a second device, it is interpreted as that the first device is directly coupled to the second device, or the first device is indirectly coupled to the second device through other devices or connection means. Moreover, wherever possible, components/members/steps using the same referential numbers in the drawings and description refer to the same or like parts. Components/members/steps using the same referential numbers or using the same terms in different embodiments may cross-refer related descriptions.

FIG. 1 is a circuit schematic diagram of a transformer 100 according to an embodiment of the disclosure. The transformer 100 includes a primary coil 110 and a secondary coil 120. Based on transmission of an induced magnetic field, the primary coil 110 and the secondary coil 120 can transit electric energy to each other. For example, electric energy at a first port Port1 and a second port Port2 of the primary coil 110 can be transmitted to a first port port3 and a second port Port2 of the secondary coil 120. By determining a ratio between a winding turns of the primary coil 110 and a winding turns of the secondary coil 120, a voltage ratio between the primary coil 110 and the secondary coil 120 is set. In the disclosure, the primary coil can be a primary side coil, and the secondary coil can be a secondary side coil. Regarding various designs of the disclosure, one or a plurality of coils all meet the spirit of the disclosure.

Figure 2:
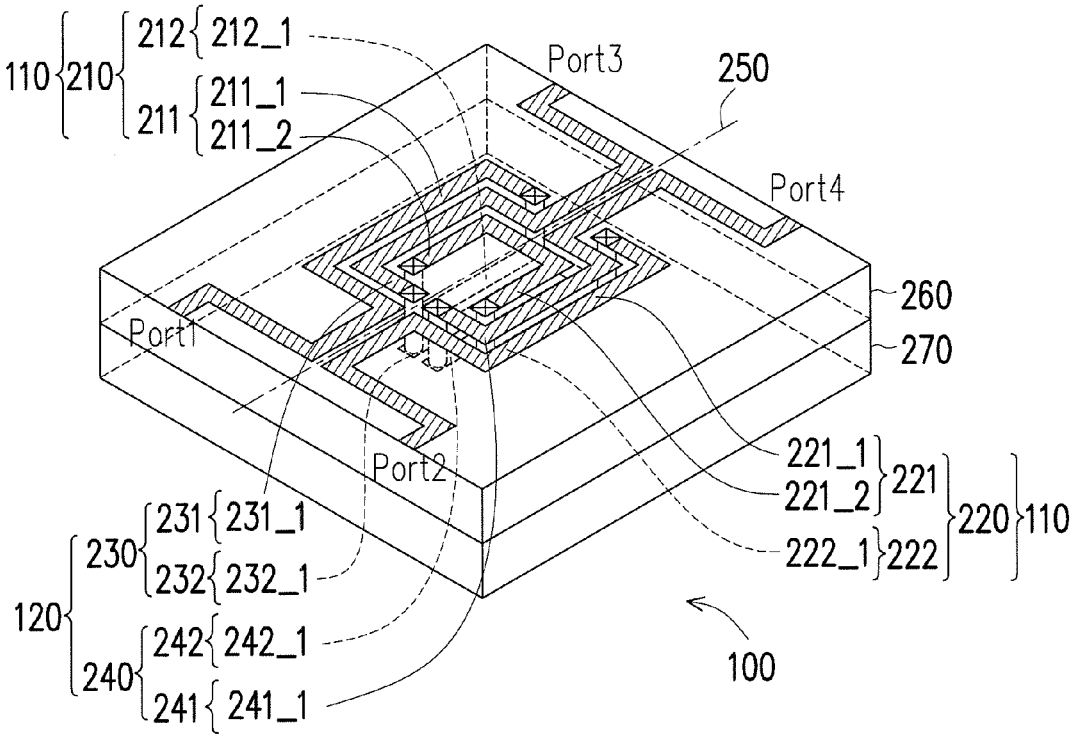
FIG. 2 is a three-dimensional perspective view of a layout structure of the transformer of FIG. 1 according to an embodiment of the disclosure.
Figure 3:
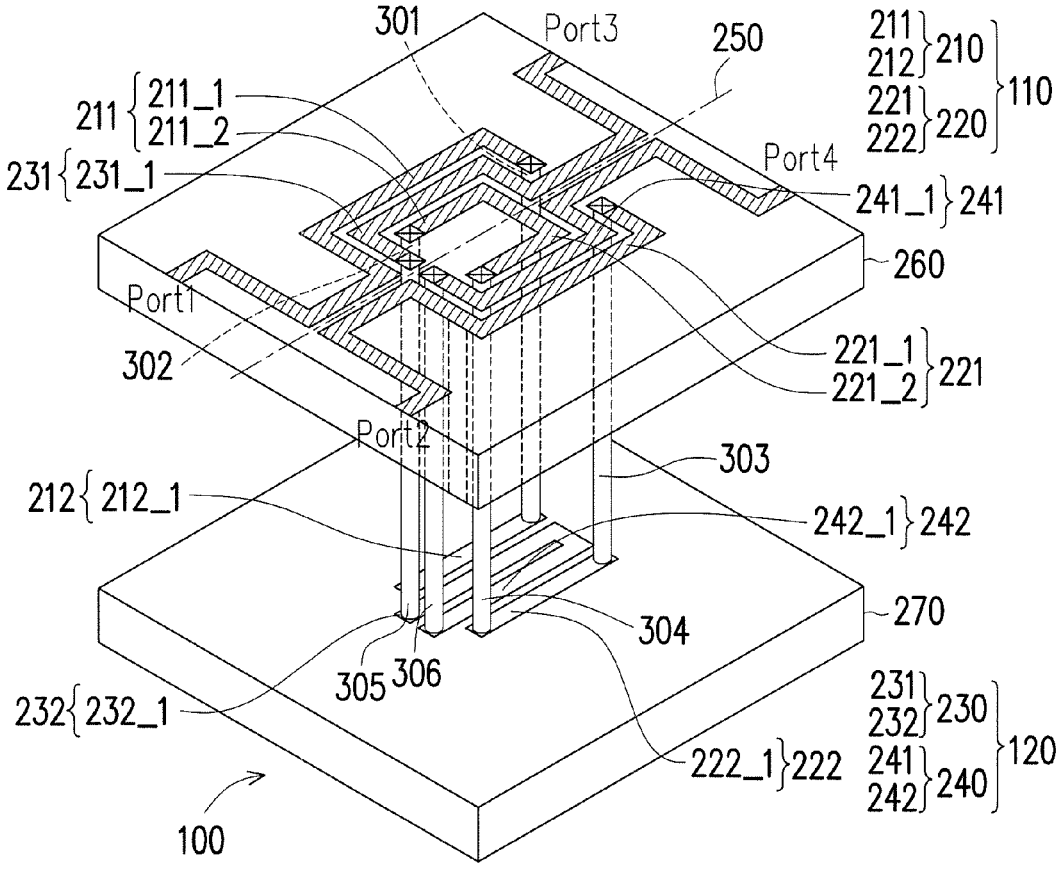
FIG. 3 is an assembling schematic diagram of the layout structure of the transformer of FIG. 2 according to an embodiment of the disclosure.
Figure 4:
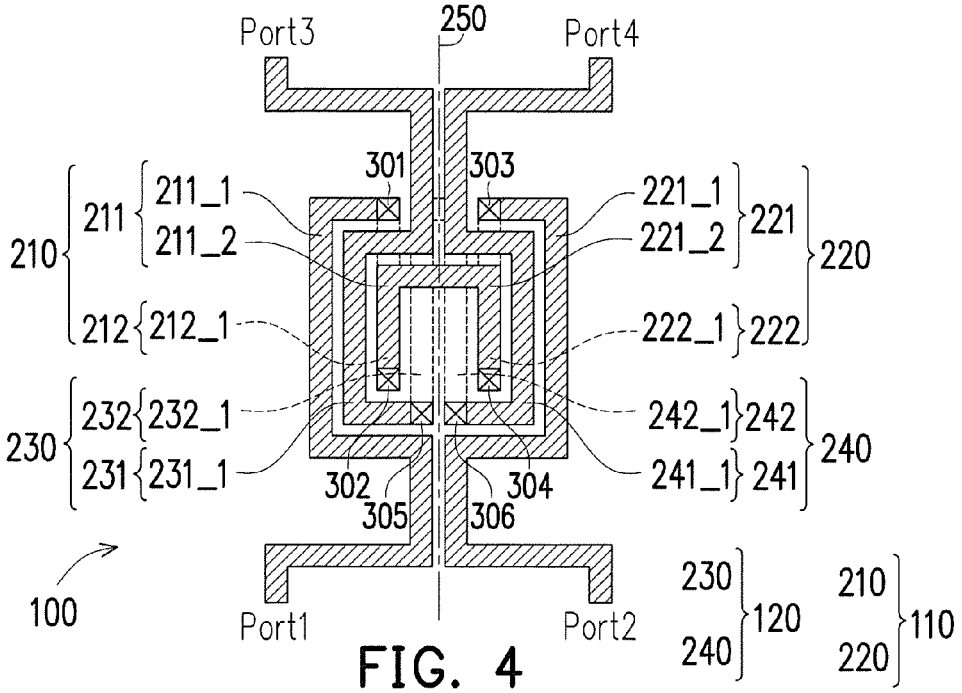
FIG. 4 is a schematic diagram of a vertical projection of the layout structure of the transformer of FIG. 2 according to an embodiment of the disclosure.

FIG. 2 is a three-dimensional perspective view of a layout structure of the transformer 100 of FIG. 1 according to an embodiment of the disclosure. FIG. 3 is an assembling schematic diagram of the layout structure of the transformer 100 of FIG. 2 according to an embodiment of the disclosure. FIG. 4 is a schematic diagram of a vertical projection of the layout structure of the transformer 100 of FIG. 2 according to an embodiment of the disclosure. Referring to FIG. 2 to FIG. 4, the transformer 100 includes the primary coil 110 and the secondary coil 120. The primary coil 110 includes a first electrical path 210 and a second electrical path 220. The first electrical path 210 and the second electrical path 220 are respectively located at different sides of a symmetry line 250 on a projection plane (shown in FIG. 4) of the transformer 100. A first terminal of the first electrical path 210 and a first terminal of the second electrical path 220 respectively serve as the first port Port1 and the second port Port2 of the primary coil 110. A second terminal of the first electrical path 210 is connected to a second terminal of the second electrical path 220 at the symmetry line 250. The first electrical path 210 and the second electrical path 220 are symmetric relative to the symmetry line 250, as shown in FIG. 4.

The first electrical path 210 includes a first partial path 211 disposed on a first substrate 260 and a second partial path 212 disposed on a second substrate 270. The first partial path 211 and the second partial path 212 are connected to each other by at least one through silicon via (TSV). The second electrical path 220 includes a third partial path 221 disposed on the first substrate 260 and a fourth partial path 222 disposed on the second substrate 270. The third partial path 221 and the fourth partial path 222 are connected to each other by at least one TSV.

The secondary coil 120 includes a third electrical path 230 and a fourth electrical path 240. The third electrical path 230 and the fourth electrical path 240 are respectively located at different sides of the symmetry line 250 on the projection plane (shown in FIG. 4). A first terminal of the third electrical path 230 and a first terminal of the fourth electrical path 240 respectively serve as a first port Port3 and a second port Port4 of the secondary coil 120. A second terminal of the third electrical path 230 is connected to a second terminal of the fourth electrical path 240 at the symmetry line 250. The third electrical path 230 and the fourth electrical path 240 are symmetric relative to the symmetry line 250, as shown in FIG. 4.

The third electrical path 230 includes a fifth partial path 231 disposed on the first substrate 260 and a sixth partial path 232 disposed on the second substrate 270. The fifth partial path 231 and the sixth partial path 232 are connected to each other by at least one TSV. The fourth electrical path 240 includes a seventh partial path 241 disposed on the first substrate 260 and an eighth partial path 242 disposed on the second substrate 270. The seventh partial path 241 and the eighth partial path 242 are connected to each other by at least one TSV.

In one embodiment, the layout structure of the transformer 100 can be applied to any type of integrated circuit (IC) having TSVs. In some embodiment, the layout structure of the transformer 100 can be applied to chip stacking having two chip-layers (or more chip-layers). For example (though the disclosure is not limited thereto), the first substrate 260 and the second substrate 270 can be different chips in a three-dimensional (3D) chip stacking structure. The first partial path 211, the third partial path 221, the fifth partial path 231 and the seventh partial path 241 can be allocated to a re-distributed layer (RDL) on the first substrate 260 (an upper layer chip), and the second partial path 212, the fourth partial path 222, the sixth partial path 232 and the eighth partial path 242 can be allocated to a RDL of the second substrate 270 (a lower layer chip).

In other embodiments, the layout structure of the transformer 100 can be applied to a single layer chip. For example (though the disclosure is not limited thereto), the first substrate 260 and the second substrate 270 can be different RDLs in a same chip. It is assumed that the first substrate 260 and the second substrate 270 are respectively a first RDL (for example, an upper RDL) and a second RDL (for example, a lower RDL) in the same chip. In this way, the first partial path 211, the third partial path 221, the fifth partial path 231 and the seventh partial path 241 can be allocated to the first RDL in the same chip, and the second partial path 212, the fourth partial path 222, the sixth partial path 232 and the eighth partial path 242 can be allocated to the second RDL in the same chip.

When a current direction of the first partial path 211 is a first direction along the symmetry line 250, a current direction of the second partial path 212 is a second direction along the symmetry line 250, a current direction of the third partial path 221 is the second direction, and a current direction of the fourth partial path 222 is the first direction. The first direction is different to the second direction, for example, the first direction is inversed to the second direction. Moreover, when a current direction of the fifth partial path 231 is the first direction, a current direction of the sixth partial path 232 is the second direction, a current direction of the seventh partial path 241 is the second direction, and a current direction of the eighth partial path 242 is the first direction.

In the embodiment of FIG. 2 to FIG. 4, the first partial path 211 of the primary coil 110 includes a first wire segment 211_1 and a second wire segment 211_2, and the second partial path 212 of the primary coil 110 includes a third wire segment 212_1. A first terminal of the first wire segment 211_1 serves as the first port Port1 of the primary coil 110. A second terminal of the first wire segment 211_1 is connected to a first terminal of the third wire segment 212_1 through a first TSV 301. A second terminal of the third wire segment 212_1 is connected to a first terminal of the second wire segment 211_2 through a second TSV 302. In an embodiment, the first wire segment 211_1 is a bendable line segment, the second wire segment 211_2 is a half of a U-shape line segment presenting a shape of "L", and the third wire segment 212_1 is a straight line segment.

The third partial path 221 of the primary coil 110 includes a fourth wire segment 221_1 and a fifth wire segment 221_2, and the fourth partial path 222 of the primary coil 110 includes a sixth wire segment 222_1. A first terminal of the fourth wire segment 221_1 serves as the second port Port2 of the primary coil 110. A second terminal of the fourth wire segment 221_1 is connected to a first terminal of the sixth wire segment 222_1 through a third TSV 303. A second terminal of the sixth wire segment 222_1 is connected to a first terminal of the fifth wire segment 221_2 through a fourth TSV 304. A second terminal of the fifth wire segment 221_2 is connected to a second terminal of the second wire segment 211_2 at the symmetry line 250. In an embodiment, the fourth wire segment 221_1 is a bendable line segment, the fifth wire segment 221_2 is a half of the U-shape line segment presenting a shape of "L" and is connected to the second wire segment 211_2 to present the U-shape line segment, and the sixth wire segment 222_1 is a straight line segment. The fifth wire segment 221_2 can be connected to the second wire segment 211_2 to present the U-shape line segment.

The fifth partial path 231 of the secondary coil 120 includes a first wire segment 231_1, and the sixth partial path 232 includes a second wire segment 232_1. A first terminal of the first wire segment 231_1 serves as the first port Port3 of the secondary coil 120. A second terminal of the first wire segment 231_1 is connected to a first terminal of the second wire segment 232_1 through a first TSV 305. The seventh partial path 241 of the secondary coil 120 includes a third wire segment 241_1, and the eighth partial path 242 includes a fourth wire segment 242_1. A first terminal of the third wire segment 241_1 serves as the second port Port4 of the secondary coil 120. A second terminal of the third wire segment 241_1 is connected to a first terminal of the fourth wire segment 242_1 through a first TSV 306. A second terminal of the fourth wire segment 242_1 is connected to a second terminal of the second wire segment 232_1. In an embodiment, the first wire segment 231_1 is a bendable line segment, and the second wire segment 232_1 is a half of a U-shape line segment presenting a shape of "L". The third wire segment 241_1 is a bendable line segment, and the fourth wire segment 242_1 is a half of the U-shape line segment presenting a shape of "L" and is connected to the second wire segment 232_1 to present the U-shape line segment. In an embodiment, the first wire segment 231_1 is configured between the first wire segment 211_1 and the second wire segment 211_2, and the third wire segment 241_1 is configured between the fourth wire segment 221_1 and the fifth wire segment 221_2. In an embodiment, the second wire segment 232_1 is connected to the fourth wire segment 242_1 to form the U-shape line segment, and the U-shape line segment formed by connecting the second wire segment 232_1 and the fourth wire segment 242_1 is configured between the third wire segment 212_and the sixth wire segment 222_1.

In order to decrease a common mode noise, a system circuit is generally designed into a differential type to increase a differential gain and suppress a common mode noise gain thereof. In this way, integrated passive devices (IPDs) usually place emphasis on a symmetrical structure to cope with the differential signal. If the symmetry line 250 is taken as a center line of the transformer, regions to the left and right of the symmetry line 250 have a mirror symmetric layout, so that the 3D symmetrical vertical transformer 100 of a 3DIC of the embodiment has good structural symmetry. Therefore, the transformer 100 is adapted to a circuit design of a differential structure. According to the embodiment of FIG. 2 to FIG. 4, a turns ratio between the primary coil 110 and the secondary coil 120 is 2:1, so that the transformer 100 shown in FIG. 2 to FIG. 4 is a transformer with the turns ratio of 2:1. In one embodiment, the TSV vertical paths and planar paths of different substrates (chips) in the 3DIC manufacturing process are used to implement the symmetrical transformer 100. Therefore, the transformer 100 can save chip area. Moreover, the transformer 100 can be applied to vertical signal coupling transmission between different chips.

Figure 5:
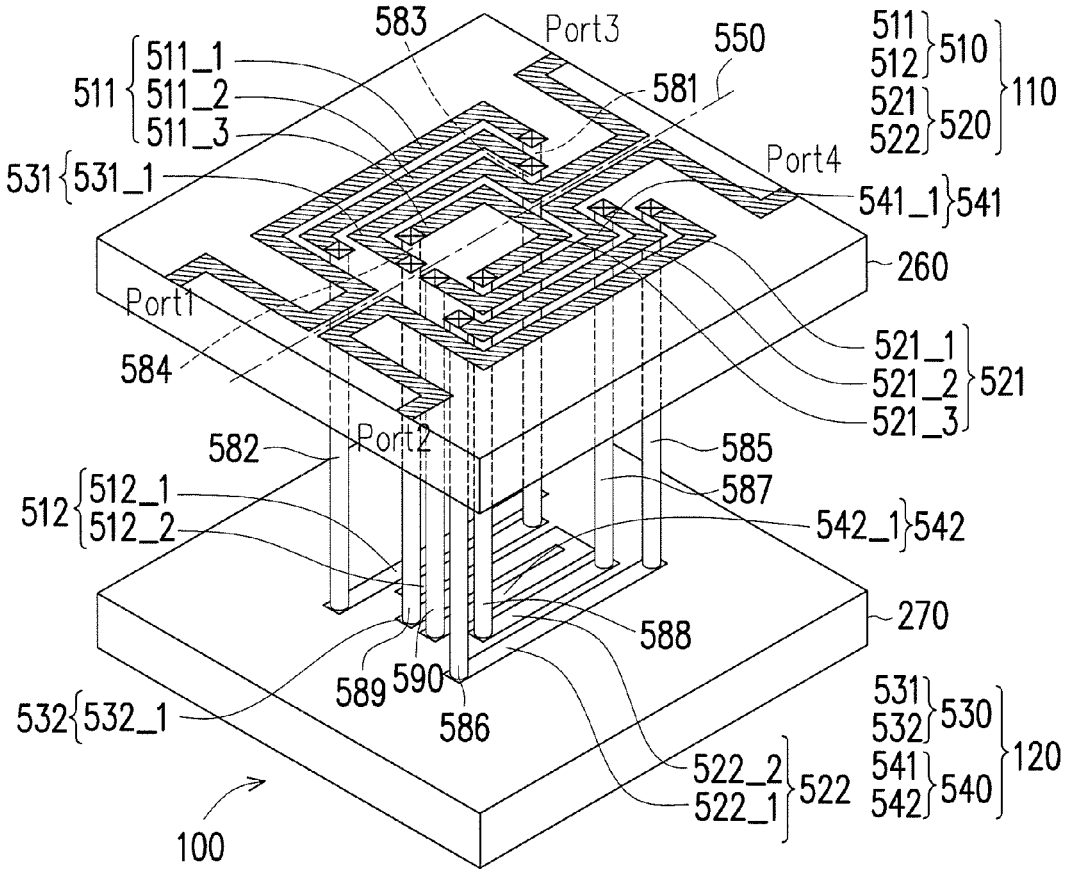
FIG. 5 is an assembling schematic diagram of the layout structure of the transformer of FIG. 1 according to another embodiment of the disclosure.
Figure 6:
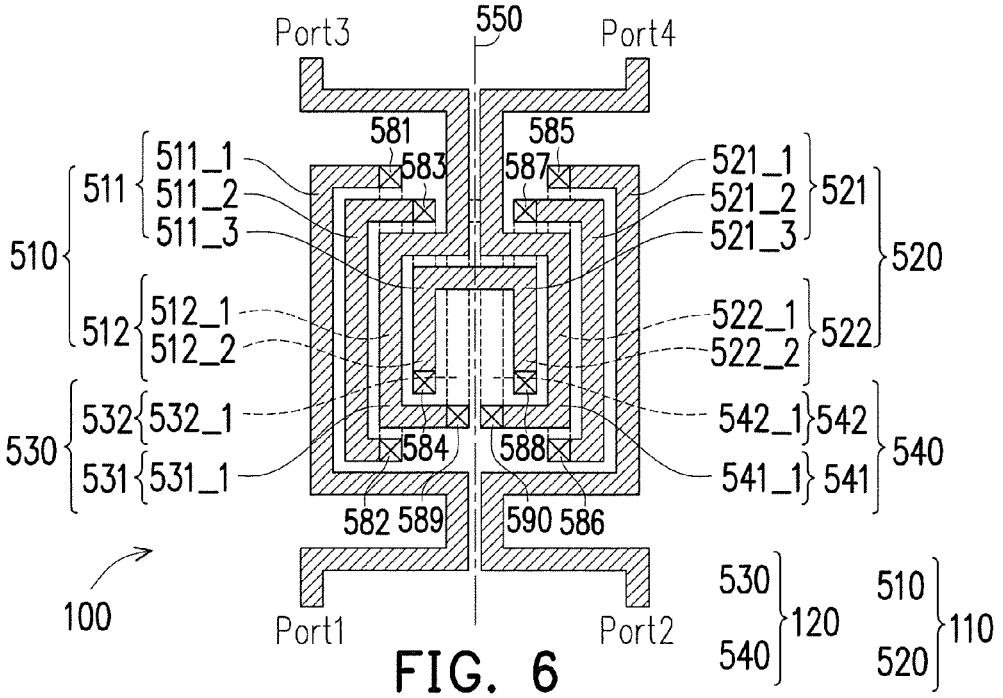
FIG. 6 is a schematic diagram of a vertical projection of the layout structure of the transformer of FIG. 5 according to an embodiment of the disclosure.

However, implementation of the transformer 100 of FIG. 1 is not limited to the embodiment shown in FIG. 2 to FIG. 4. For example, FIG. 5 is an assembling schematic diagram of the layout structure of the transformer 100 of FIG. 1 according to another embodiment of the disclosure. FIG. 6 is a schematic diagram of a vertical projection of the layout structure of the transformer 100 of FIG. 5 according to an embodiment of the disclosure. Referring to FIG. 5 and FIG. 6, the transformer 100 includes the primary coil 110 and the secondary coil 120. The primary coil 110 includes a first electrical path 510 and a second electrical path 520. The first electrical path 510 and the second electrical path 520 are respectively located at different sides of a symmetry line 550 on a projection plane (shown in FIG. 6) of the transformer 100. A first terminal of the first electrical path 510 and a first terminal of the second electrical path 520 respectively serve as the first port Port1 and the second port Port2 of the primary coil 110. A second terminal of the first electrical path 510 is connected to a second terminal of the second electrical path 520 at the symmetry line 550. The first electrical path 510 and the second electrical path 520 are symmetric relative to the symmetry line 550, as shown in FIG. 6. The secondary coil 120 includes a third electrical path 530 and a fourth electrical path 540. The third electrical path 530 and the fourth electrical path 540 are respectively located at different sides of the symmetry line 550 on the projection plane (shown in FIG. 6).

A first terminal of the third electrical path 530 and a first terminal of the fourth electrical path 540 respectively serve as the first port Port3 and the second port Port4 of the secondary coil 120. A second terminal of the third electrical path 530 is connected to a second terminal of the fourth electrical path 540 at the symmetry line 550. The third electrical path 530 and the fourth electrical path 540 are symmetric relative to the symmetry line 550, as shown in FIG. 6. The transformer 100, the first electrical path 510, the second electrical path 520, the third electrical path 530 and the fourth electrical path 540 shown in FIG. 5 and FIG. 6 can be deduced according to related description of the transformer 100, the first electrical path 210, the second electrical path 220, the third electrical path 230 and the fourth electrical path 240 shown in FIG. 2 to FIG. 4, and details thereof are not repeated.

The first electrical path 510 includes a first partial path 511 disposed on the first substrate 260 and a second partial path 512 disposed on the second substrate 270. The second electrical path 520 includes a third partial path 521 disposed on the first substrate 260 and a fourth partial path 522 disposed on the second substrate 270. The third electrical path 530 includes a fifth partial path 531 disposed on the first substrate 260 and a sixth partial path 532 disposed on the second substrate 270. The fourth electrical path 540 includes a seventh partial path 541 disposed on the first substrate 260 and an eighth partial path 542 disposed on the second substrate 270. In one embodiment (though the disclosure is not limited thereto), the first partial path 511, the third partial path 521, the fifth partial path 531 and the seventh partial path 541 are allocated to a RDL on the first substrate 260 (the upper layer chip), and the second partial path 512, the fourth partial path 522, the sixth partial path 532 and the eighth partial path 542 are allocated to a RDL of the second substrate 270 (the lower layer chip).

In the embodiment of FIG. 5 to FIG. 6, the first partial path 511 of the primary coil 110 includes a first wire segment 511_1, a second wire segment 511_2 and a third wire segment 511_3, and the second partial path 512 of the primary coil 110 includes a fourth wire segment 512_1 and a fifth wire segment 512_2. A first terminal of the first wire segment 511_1 serves as the first port Port1 of the primary coil 110. A second terminal of the first wire segment 511_1 is connected to a first terminal of the fourth wire segment 512_1 through a first TSV 581. A second terminal of the fourth wire segment 512_1 is connected to a first terminal of the second wire segment 511_2 through a second TSV 582. A second terminal of the second wire segment 511_2 is connected to a first terminal of the fifth wire segment 512_2 through a third TSV 583. A second terminal of the fifth wire segment 512_2 is connected to a first terminal of the third wire segment 511_3 through a fourth TSV 584. In an embodiment, the first wire segment 511_1 is a bendable line segment, the second wire segment 511_2 is a U-shape line segment, the third wire segment 511_3 is a half of a U-shape line segment presenting a shape of "L", and the fourth wire segment 512_1 and the fifth wire segment 512_2 are straight line segments.

The third partial path 521 of the primary coil 110 includes a sixth wire segment 521_1, a seventh wire segment 521_2 and an eighth wire segment 521_3, and the fourth partial path 522 of the primary coil 110 includes a ninth wire segment 522_1 and a tenth wire segment 522_2. A first terminal of the sixth wire segment 521_1 serves as the second port Port2 of the primary coil 110. A second terminal of the sixth wire segment 521_1 is connected to a first terminal of the ninth wire segment 522_1 through a fifth TSV 585. A second terminal of the ninth wire segment 522_1 is connected to a first terminal of the seventh wire segment 521_2 through a sixth TSV 586. A second terminal of the seventh wire segment 521_2 is connected to a first terminal of the tenth wire segment 522_2 through a seventh TSV 587. A second terminal of the tenth wire segment 522_2 is connected to a first terminal of the eighth wire segment 521_3 through an eighth TSV 588. A second terminal of the eighth wire segment 521_3 is connected to the second terminal of the third wire segment 511_3 at the symmetry line 550. In an embodiment, the sixth wire segment 521_1 is a bendable line segment, the seventh wire segment 521_2 is a U-shape line segment, the eighth wire segment 521_3 is a half of the U-shape line segment presenting a shape of "L", and the ninth wire segment 522_1 and the tenth wire segment 522_2 are straight line segments. The eighth wire segment 521_3 can be connected to the third wire segment 511_3 to present the U-shape line segment.

The fifth partial path 531 of the secondary coil 120 includes a first wire segment 531_1, and the sixth partial path 532 includes a second wire segment 532_1. A first terminal of the first wire segment 531_1 serves as the first port Port3 of the secondary coil 120. A second terminal of the first wire segment 531_1 is connected to a first terminal of the second wire segment 532_1 through a first TSV 589. The seventh partial path 541 of the secondary coil 120 includes a third wire segment 541_1, and the eighth partial path 542 includes a fourth wire segment 542_1. A first terminal of the third wire segment 541_1 serves as the second port Port4 of the secondary coil 120. A second terminal of the third wire segment 541_1 is connected to a first terminal of the fourth wire segment 542_1 through a second TSV 590. A second terminal of the fourth wire segment 542_1 is connected to a second terminal of the second wire segment 532_1. In an embodiment, the first wire segment 531_1 is a bendable line segment, and the second wire segment 532_1 is a half of a U-shape line segment presenting a shape of "L". The third wire segment 541_1 is a bendable line segment, and the fourth wire segment 542_1 is a half of the U-shape line segment presenting a shape of "L" and is connected to the second wire segment 532_1 to present the U-shape line segment. In an embodiment, the first wire segment 531_1 is configured between the second wire segment 511_2 and the third wire segment 511_3, and the third wire segment 541_1 is configured between the seventh wire segment 521_2 and the eighth wire segment 521_3. In an embodiment, the second wire segment 532_1 is connected to the fourth wire segment 542_1 to form the U-shape line segment, and the U-shape line segment formed by connecting the second wire segment 532_1 and the fourth wire segment 542_1 is configured between the fifth wire segment 512_2 and the tenth wire segment 522_2.

If the symmetry line 550 is taken as a center line of the transformer, regions to the left and right of the symmetry line 550 have a mirror symmetric layout, so that the 3D symmetrical vertical transformer 100 of the 3DIC shown in FIG. 5 to FIG. 6 has good structural symmetry. Therefore, the transformer 100 of FIG. 5 to FIG. 6 is adapted to a circuit design of a differential structure. According to the embodiment of FIG. 5 to FIG. 6, a turns ratio between the primary coil 110 and the secondary coil 120 is 3:1, so that the transformer 100 shown in FIG. 5 to FIG. 6 is a transformer with the turns ratio of 3:1. In one embodiment, the TSV vertical paths and planar paths of different substrates (chips) in the 3DIC manufacturing process are used to implement the symmetrical transformer 100. Therefore, the transformer 100 can save chip area. Moreover, the transformer 100 can be applied to vertical signal coupling transmission between different chips.

Figure 7:
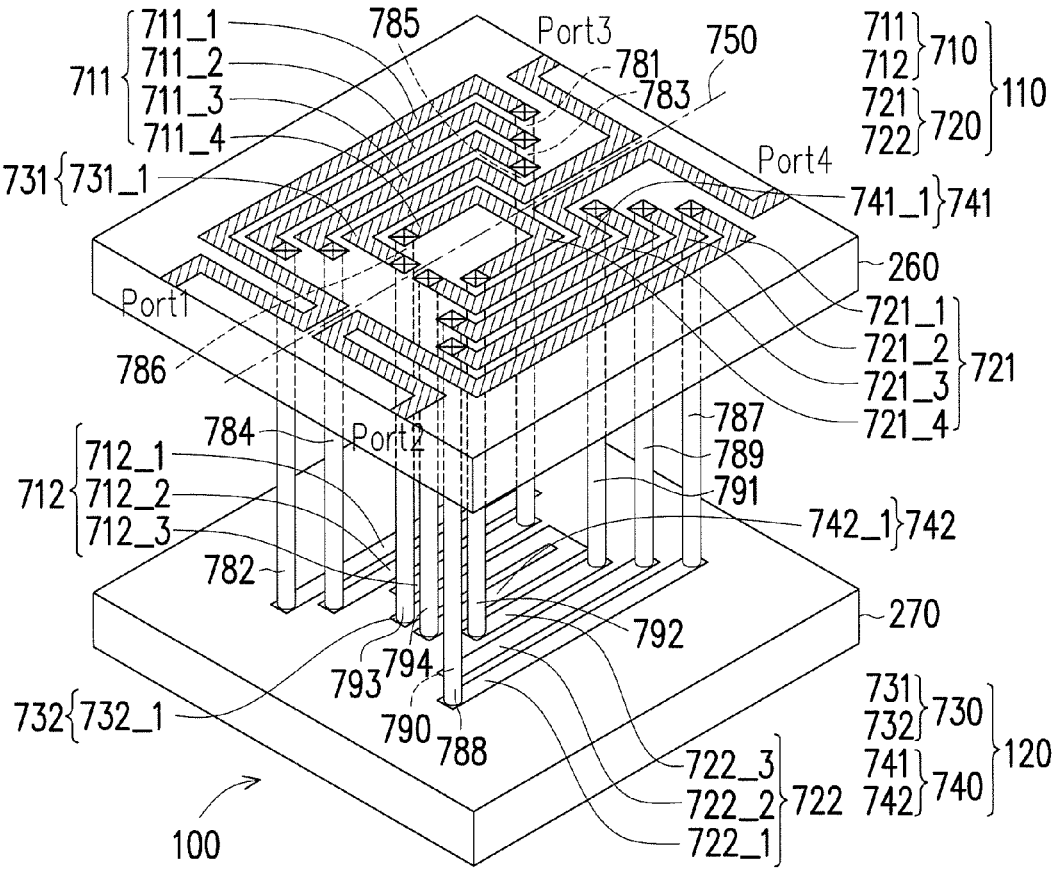
FIG. 7 is an assembling schematic diagram of the layout structure of the transformer of FIG. 1 according to still another embodiment of the disclosure.
Figure 8:
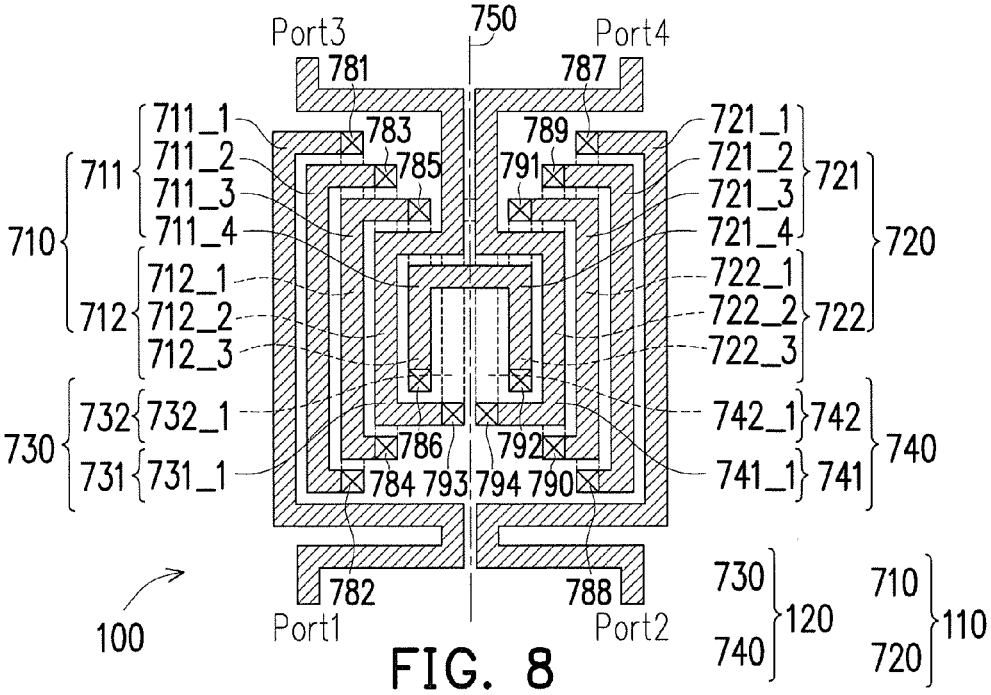
FIG. 8 is a schematic diagram of a vertical projection of the layout structure of the transformer of FIG. 7 according to an embodiment of the disclosure.

FIG. 7 is an assembling schematic diagram of the layout structure of the transformer 100 of FIG. 1 according to still another embodiment of the disclosure. FIG. 8 is a schematic diagram of a vertical projection of the layout structure of the transformer 100 of FIG. 7 according to an embodiment of the disclosure. Referring to FIG. 7 and FIG. 8, the transformer 100 includes the primary coil 110 and the secondary coil 120. The primary coil 110 includes a first electrical path 710 and a second electrical path 720. The first electrical path 710 and the second electrical path 720 are respectively located at different sides of a symmetry line 750 on a projection plane (shown in FIG. 8) of the transformer 100. A first terminal of the first electrical path 710 and a first terminal of the second electrical path 720 respectively serve as the first port Port1 and the second port Port2 of the primary coil 110. A second terminal of the first electrical path 710 is connected to a second terminal of the second electrical path 720 at the symmetry line 750. The first electrical path 710 and the second electrical path 720 are symmetric relative to the symmetry line 750, as shown in FIG. 8. The secondary coil 120 includes a third electrical path 730 and a fourth electrical path 740. The third electrical path 730 and the fourth electrical path 740 are respectively located at different sides of the symmetry line 750 on the projection plane (shown in FIG. 8). A first terminal of the third electrical path 730 and a first terminal of the fourth electrical path 740 respectively serve as the first port Port3 and the second port Port4 of the secondary coil 120. A second terminal of the third electrical path 730 is connected to a second terminal of the fourth electrical path 740 at the symmetry line 750. The third electrical path 730 and the fourth electrical path 740 are symmetric relative to the symmetry line 750, as shown in FIG. 8. The transformer 100, the first electrical path 710, the second electrical path 720, the third electrical path 730 and the fourth electrical path 740 shown in FIG. 7 and FIG. 8 can be deduced according to related description of the transformer 100, the first electrical path 210, the second electrical path 220, the third electrical path 230 and the fourth electrical path 240 shown in FIG. 2 to FIG. 4, and details thereof are not repeated.

The first electrical path 710 includes a first partial path 711 disposed on the first substrate 260 and a second partial path 712 disposed on the second substrate 270. The second electrical path 720 includes a third partial path 721 disposed on the first substrate 260 and a fourth partial path 722 disposed on the second substrate 270. The third electrical path 730 includes a fifth partial path 731 disposed on the first substrate 260 and a sixth partial path 732 disposed on the second substrate 270. The fourth electrical path 740 includes a seventh partial path 741 disposed on the first substrate 260 and an eighth partial path 742 disposed on the second substrate 270. In one embodiment (though the disclosure is not limited thereto), the first partial path 711, the third partial path 721, the fifth partial path 731 and the seventh partial path 741 are allocated to a RDL on the first substrate 260 (the upper layer chip), and the second partial path 712, the fourth partial path 722, the sixth partial path 732 and the eighth partial path 742 are allocated to a RDL of the second substrate 270 (the lower layer chip).

In the embodiment of FIG. 7 to FIG. 8, the first partial path 711 of the primary coil 110 includes a first wire segment 711_, a second wire segment 711_2, a third wire segment 711_3 and a fourth wire segment 711_4, and the second partial path 712 of the primary coil 110 includes a fifth wire segment 712_1, a sixth wire segment 712_2 and a seventh wire segment 712_3. A first terminal of the first wire segment 711_1 serves as the first port Port1 of the primary coil 110. A second terminal of the first wire segment 711_1 is connected to a first terminal of the fifth wire segment 712_1 through a first TSV 781. A second terminal of the fifth wire segment 712_1 is connected to a first terminal of the second wire segment 711_2 through a second TSV 782. A second terminal of the second wire segment 711_2 is connected to a first terminal of the sixth wire segment 712_2 through a third TSV 783. A second terminal of the sixth wire segment 712_2 is connected to a first terminal of the third wire segment 711_3 through a fourth TSV 784. A second terminal of the third wire segment 711_3 is connected to a first terminal of the seventh wire segment 712_3 through a fifth TSV 785. A second terminal of the seventh wire segment 712_3 is connected to a first terminal of the fourth wire segment 711_4 through a sixth TSV 786. In an embodiment, the first wire segment 711_1 is a bendable line segment, the second wire segment 711_2 and the third wire segment 711_3 are U-shape line segments, the fourth wire segment 711_4 is a half of a U-shape line segment presenting a shape of "L", and the fifth wire segment 712_1, the sixth wire segment 712_2 and the seventh wire segment 712_3 are straight line segments.

The third partial path 721 of the primary coil 110 includes an eighth wire segment 721_1, a ninth wire segment 721_2, a tenth wire segment. 721_3 and an eleventh wire segment 721_6, and the fourth partial path 722 of the primary coil 110 includes a twelfth wire segment 722_1, a thirteenth wire segment 722_2 and a fourteenth wire segment 722_3. A first terminal of the eighth wire segment 721_1 serves as the second port Port2 of the primary coil 110. A second terminal of the eighth wire segment 721_1 is connected to a first terminal of the twelfth wire segment 722_1 through a seventh TSV 787. A second terminal of the twelfth wire segment 722_1 is connected to a first terminal of the ninth wire segment 721_2 through an eighth TSV 788. A second terminal of the ninth wire segment 721_2 is connected to a first terminal of the thirteenth wire segment 722_2 through a ninth TSV 789. A second terminal of the thirteenth wire segment 722_2 is connected to a first terminal of the tenth wire segment 721_3 through a tenth TSV 790. A second terminal of the tenth wire segment 721_3 is connected to a first terminal of the fourteenth wire segment 722_3 through an eleventh TSV 791. A second terminal of the fourteenth wire segment 722_3 is connected to a first terminal of the eleventh wire segment 721_4 through a twelfth TSV 792. A second terminal of the eleventh wire segment 721_4 is connected to the second terminal of the fourth wire segment 711_4 at the symmetry line 750. In an embodiment, the eighth wire segment 721_1 is a bendable line segment, the ninth wire segment 721_2 and the tenth wire segment 721_3 are U-shape line segments, the eleventh wire segment 721_4 is a half of the U-shape line segment presenting a shape of "L", and the twelfth wire segment 722_1, the thirteenth wire segment 722_2 and the fourteenth wire segment 722_3 are straight line segments. The eleventh wire segment 721_4 can be connected to the fourth wire segment 711_4 to present the U-shape line segment.

The fifth partial path 731 of the secondary coil 120 includes a first wire segment 731_1, and the sixth partial path 732 includes a second wire segment 732_1. A first terminal of the first wire segment 731_1 serves as the first port Port3 of the secondary coil 120. A second terminal of the first wire segment 731_1 is connected to a first terminal of the second wire segment 732_1 through a first TSV 793. The seventh partial path 741 of the secondary coil 120 includes a third wire segment 741_1, and the eighth partial path 742 of the secondary coil 120 includes a fourth wire segment 742_1. A first terminal of the third wire segment 741_1 serves as the second port Port4 of the secondary coil 120. A second terminal of the third wire segment 741_1 is connected to a first terminal of the fourth wire segment 742_1 through a second TSV 794. A second terminal of the fourth wire segment 742_1 is connected to a second terminal of the second wire segment 732_1. In an embodiment, the first wire segment 731_1 is a bendable line segment, and the second wire segment 732_1 is a half of a U-shape line segment presenting a shape of "L". The third wire segment 741_1 is a bendable line segment, and the fourth wire segment 742_1 is a half of the U-shape line segment presenting a shape of "L" and is connected to the second wire segment 732_1 to present the U-shape line segment. In an embodiment, the first wire segment 731_1 is configured between the third wire segment 711_3 and the fourth wire segment 711_4, and the third wire segment 741_1 is configured between the tenth wire segment 721_3 and the eleventh wire segment 721_4. In an embodiment, the second wire segment 732_1 is connected to the fourth wire segment 742_1 to form the U-shape line segment, and the U-shape line segment formed by connecting the second wire segment 732_1 and the fourth wire segment 742_1 is configured between the seventh wire segment 712_3 and the fourteenth wire segment 722_3.

If the symmetry line 750 is taken as a center line of the transformer, regions to the left and right of the symmetry line 750 have a mirror symmetric layout, so that the 3D symmetrical vertical transformer 100 of the 3DIC shown in FIG. 7 to FIG. 8 has good structural symmetry. Therefore, the transformer 100 of FIG. 7 to FIG. 8 is adapted to a circuit design of a differential structure. According to the embodiment of FIG. 7 to FIG. 8, a turns ratio between the primary coil 110 and the secondary coil 120 is 4:1, so that the transformer 100 shown in FIG. 7 to FIG. 8 is a transformer with the turns ratio of 4:1. In one embodiment, the TSV vertical paths and planar paths of different substrates (chips) in the 3DIC manufacturing process are used to implement the symmetrical transformer 100. Therefore, the transformer 100 can save chip area. Moreover, the transformer 100 can be applied to vertical signal coupling transmission between different chips.

Figure 9:
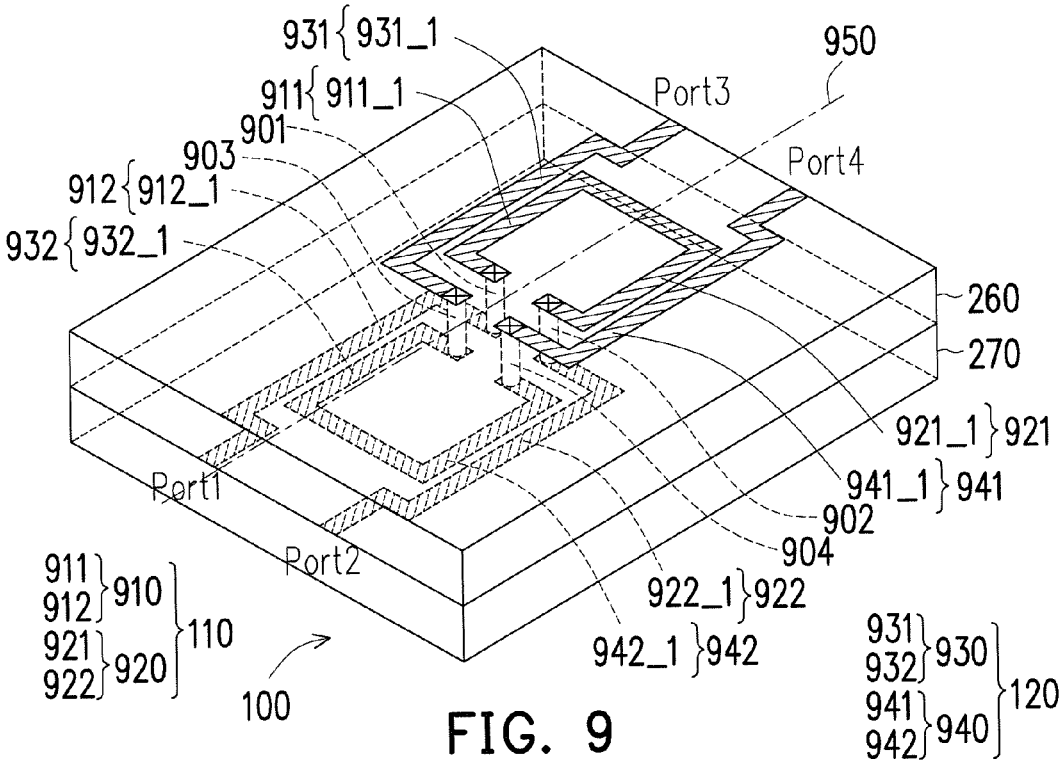
FIG. 9 is an assembling schematic diagram of the layout structure of the transformer of FIG. 1 according to yet another embodiment of the disclosure.
Figure 10:
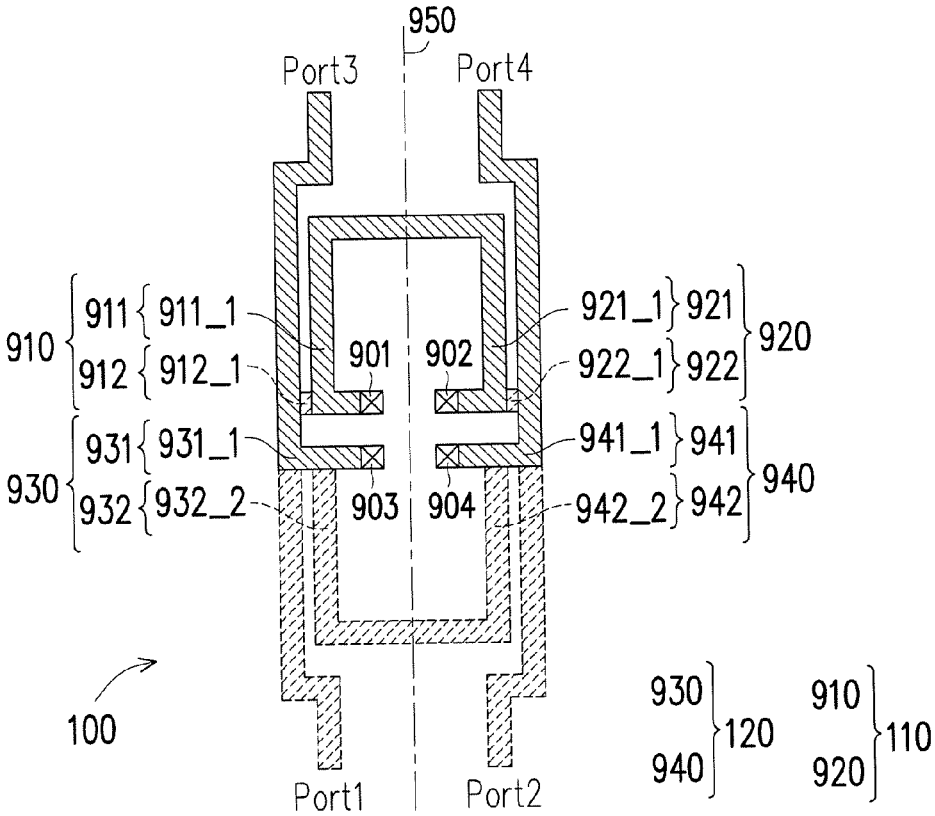
FIG. 10 is a schematic diagram of a vertical projection of the layout structure of the transformer of FIG. 9 according to an embodiment of the disclosure.

FIG. 9 is an assembling schematic diagram of the layout structure of the transformer 100 of FIG. 1 according to yet another embodiment of the disclosure. FIG. 10 is a schematic diagram of a vertical projection of the layout structure of the transformer 100 of FIG. 9 according to an embodiment of the disclosure. Referring to FIG. 9 and FIG. 10, the transformer 100 includes the primary coil 110 and the secondary coil 120. The primary coil 110 includes a first electrical path 910 and a second electrical path 920. The first electrical path 910 and the second electrical path 920 are respectively located at different sides of a symmetry line 950 on a projection plane (shown in FIG. 10) of the transformer 100. A first terminal of the first electrical path 910 and a first terminal of the second electrical path 920 respectively serve as the first port Port1 and the second port Port2 of the primary coil 110. A second terminal of the first electrical path 910 is connected to a second terminal of the second electrical path 920 at the symmetry line 950. The first electrical path 910 and the second electrical path 920 are symmetric relative to the symmetry line 950, as shown in FIG. 10. The secondary coil 120 includes a third electrical path 930 and a fourth electrical path 940. The third electrical path 930 and the fourth electrical path 940 are respectively located at different sides of the symmetry line 950 on the projection plane (shown in FIG. 10). A first terminal of the third electrical path 930 and a first terminal of the fourth electrical path 940 respectively serve as the first port Port3 and the second port Port4 of the secondary coil 120. A second terminal of the third electrical path 930 is connected to a second terminal of the fourth electrical path 940 at the symmetry line 950. The third electrical path 930 and the fourth electrical path 940 are symmetric relative to the symmetry line 950, as shown in FIG. 10. The transformer 100, the first electrical path 910, the second electrical path 920, the third electrical path 930 and the fourth electrical path 940 shown in FIG. 9 and FIG. 10 can be deduced according to related description of the transformer 100, the first electrical path 210, the second electrical path 220, the third electrical path 230 and the fourth electrical path 240 shown in FIG. 2 to FIG. 4, and details thereof are not repeated.

The first electrical path 910 includes a first partial path 911 disposed on the first substrate 260 and a second partial path 912 disposed on the second substrate 270. The second electrical path 920 includes a third partial path 921 disposed on the first substrate 260 and a fourth partial path 922 disposed on the second substrate 270. The third electrical path 930 includes a fifth partial path 931 disposed on the first substrate 260 and a sixth partial path 932 disposed on the second substrate 270. The fourth electrical path 940 includes a seventh partial path 941 disposed on the first substrate 260 and an eighth partial path 942 disposed on the second substrate 270. In one embodiment (though the disclosure is not limited thereto), the first partial path 911, the third partial path 921, the fifth partial path 931 and the seventh partial path 941 are allocated to a RDL on the first substrate 260 (the upper layer chip), and the second partial path 912, the fourth partial path 922, the sixth partial path 932 and the eighth partial path 942 are allocated to a RDL of the second substrate 270 (the lower layer chip).

In the embodiment of FIG. 9 to FIG. 10, the second partial path 912 of the primary coil 110 includes a first wire segment 912_1, and the first partial path 911 of the primary coil 110 includes a second wire segment 911_1. A first terminal of the first wire segment 912_1 serves as the first port Port1 of the primary coil 110. A second terminal of the first wire segment 912_1 is connected to a first terminal of the second wire segment 911_1 through a first TSV 901. The fourth partial path 922 of the primary coil 110 includes a third wire segment 922_1, and the third partial path 921 of the primary coil 110 includes a fourth wire segment 921_1. A first terminal of the third wire segment 922_1 serves as the second port Port2 of the primary coil 110. A second terminal of the third wire segment 922_1 is connected to a first terminal of the fourth wire segment 921_1 through a second TSV 902. A second terminal of the fourth wire segment 921_1 is connected to a second terminal of the second wire segment 911_1. In an embodiment, the first wire segment 912_1 and the third wire segment 922_1 are bendable line segments, and the second wire segment 911_1 and the fourth wire segment 921_1 are a half of an O-shape line segment presenting a shape of "U". The second wire segment 911_1 can be connected to the fourth wire segment 921_1 to present the O-shape line segment.

The fifth partial path 931 of the secondary coil 120 includes a first wire segment 931_1, and the sixth partial path 932 of the secondary coil 120 includes a second wire segment 932_1. A first terminal of the first wire segment 931_1 serves as the first port Port3 of the secondary coil 120. A second terminal of the first wire segment 931_1 is connected to a first terminal of the second wire segment 932_1 through a first TSV 903. The seventh partial path 941 of the secondary coil 120 includes a third wire segment 941_1, and the eighth partial path 942 of the secondary coil 120 includes a fourth wire segment 942_1. A first terminal of the third wire segment 941_1 serves as the second port Port4 of the secondary coil 120. A second terminal of the third wire segment 941_1 is connected to a first terminal of the fourth wire segment 942_1 through a second TSV 904. A second terminal of the fourth wire segment 942_1 is connected to a second terminal of the second wire segment 932_1.

In an embodiment, the first wire segment 931_1 and the third wire segment 941_1 can be bendable line segments, and the second wire segment 932_1 and the fourth wire segment 942_1 are a half of an O-shape line segment presenting a shape of "U". In an embodiment, the second wire segment 932_1 and the fourth wire segment 942_1 are connected to form an O-shape line segment, and the O-shape line segment is disposed between the first wire segment 912_1 and the third wire segment 922_1. In an embodiment, the O-shape line segment formed by the second wire segment 911_1 and the fourth wire segment 921_1 is disposed between the first wire segment 93 and the third wire segment 941_1.

In an embodiment, the electrical paths of the primary coil 110 and the secondary coil 120 can be respectively located at different projection positions.

In summary, if the symmetry line 950 is taken as a center line of the transformer, regions to the left and right of the symmetry line 950 have a minor symmetric layout, so that the 3D symmetrical vertical transformer 100 of the 3DIC shown in FIG. 9 to FIG. 10 has good structural symmetry. Therefore, the transformer 100 of FIG. 9 to FIG. 10 is adapted to a circuit design of a differential structure. According to the embodiment of FIG. 9 to FIG. 10, a turns ratio between the primary coil 110 and the secondary coil 120 is 1:1, so that the transformer 100 shown in FIG. 9 to FIG. 10 is a transformer with the turns ratio of 1:1. In one embodiment, the TSV vertical paths and planar paths of different substrates (chips) in the 3DIC manufacturing process are used to implement the symmetrical transformer 100. Therefore, the transformer 100 can save chip area. Moreover, the transformer 100 can be applied to vertical signal coupling transmission between different chips.

According to the above descriptions, the TSV vertical paths and planar paths of different substrates are used to implement the symmetrical transformer (for example, a three-dimension (3D) symmetrical vertical N:1 transformer or a 3D symmetrical 1:1 transformer). Therefore, the aforementioned transformer can save chip area. Moreover, the aforementioned transformer can be applied to vertical signal coupling transmission between different chips.

It will be apparent to those skilled in the art that various modifications and variations can be made to the structure of the disclosed embodiments without departing from the scope or spirit of the disclosure. In view of the foregoing, it is intended that the disclosure cover modifications and variations of this disclosure provided they fall within the scope of the following claims and their equivalents.

What is claimed is:

1. A transformer, comprising:

a primary coil, comprising a first electrical path and a second electrical path respectively located at different sides of a symmetry line on a projection plane of the transformer, wherein a first terminal of the first electrical path and a first terminal of the second electrical path respectively serve as a first port and a second port of the primary coil, a second terminal of the first electrical path is connected to a second terminal of the second electrical path at the symmetry line, the first electrical path comprises a first partial path disposed on a first substrate and a second partial path disposed on a second substrate, the first partial path and the second partial path are connected to each other by at least one through silicon via, the second electrical path comprises a third partial path disposed on the first substrate and a fourth partial path disposed on the second substrate, and the third partial path and the fourth partial path are connected to each other by at least one through silicon via; and a secondary coil, comprising a third electrical path and a fourth electrical path respectively located at different sides of the symmetry line on the projection plane, wherein a first terminal of the third electrical path and a first terminal of the fourth electrical path respectively serve as a first port and a second port of the secondary coil, a second terminal of the third electrical path is connected to a second terminal of the fourth electrical path at the symmetry line, the third electrical path comprises a fifth partial path disposed on the first substrate and a sixth partial path disposed on the second substrate, the fifth partial path and the sixth partial path are connected to each other by at least one through silicon via, the fourth electrical path comprises a seventh partial path disposed on the first substrate and an eighth partial path disposed on the second substrate, and the seventh partial path and the eighth partial path are connected to each other by at least one through silicon via.

2. The transformer as claimed in claim 1, wherein the first substrate and the second substrate are respectively different chips in a three-dimension chip stacking.

3. The transformer as claimed in claim 2, wherein the first partial path, the third partial path, the fifth partial path and the seventh partial path are allocated to a re-distributed layer on the first substrate, and the second partial path, the fourth partial path, the sixth partial path and the eighth partial path are allocated to a re-distributed layer of the second substrate.

4. The transformer as claimed in claim 1, wherein the first substrate and the second substrate are respectively different re-distributed layers in a same chip.

5. The transformer as claimed in claim 4, wherein the first substrate and the second substrate are respectively a first re-distributed layer and a second re-distributed layer in the same chip, the first partial path, the third partial path, the fifth partial path and the seventh partial path are allocated to the first re-distributed layer, and the second partial path, the fourth partial path, the sixth partial path and the eighth partial path are allocated to the second re-distributed layer.

6. The transformer as claimed in claim 1, wherein the first electrical path and the second electrical path are symmetric relative to the symmetry line, and the third electrical path and the fourth electrical path are symmetric relative to the symmetry line.

7. The transformer as claimed in claim 1, wherein when a current direction of the first partial path is a first direction along the symmetry line, a current direction of the second partial path is a second direction along the symmetry line, a current direction of the third partial path is the second direction, and a current direction of the fourth partial path is the first direction; and wherein when a current direction of the fifth partial path is the first direction, a current direction of the sixth partial path is the second direction, a current direction of the seventh partial path is the second direction, and a current direction of the eighth partial path is the first direction.

8. The transformer as claimed in claim 1, wherein the fifth partial path comprises a first wire segment, the sixth partial path comprises a second wire segment, a first terminal of the first wire segment serves as the first port of the secondary coil, and a second terminal of the first wire segment is connected to a first terminal of the second wire segment through a first through silicon via; and wherein the seventh partial path comprises a third wire segment, the eighth partial path comprises a fourth wire segment, a first terminal of the third wire segment serves as the second port of the secondary coil, a second terminal of the third wire segment is connected to a first terminal of the fourth wire segment through a second through silicon via, and a second terminal of the fourth wire segment is connected to a second terminal of the second wire segment.

9. The transformer as claimed in claim 1, wherein the first partial path comprises a first wire segment and a second wire segment, the second partial path comprises a third wire segment, a first terminal of the first wire segment serves as the first port of the primary coil, a second terminal of the first wire segment is connected to a first terminal of the third wire segment through a first through silicon via, and a second terminal of the third wire segment is connected to a first terminal of the second wire segment through a second through silicon via; and wherein the third partial path comprises a fourth wire segment and a fifth wire segment, the fourth partial path comprises a sixth wire segment, a first terminal of the fourth wire segment serves as the second port of the primary coil, a second terminal of the fourth wire segment is connected to a first terminal of the sixth wire segment through a third through silicon via, a second terminal of the sixth wire segment is connected to a first terminal of the fifth wire segment through a fourth through silicon via, and a second terminal of the fifth wire segment is connected to a second terminal of the second wire segment at the symmetry line.

10. The transformer as claimed in claim 1, wherein the first partial path comprises a first wire segment, a second wire segment and a third wire segment, the second partial path comprises a fourth wire segment and a fifth wire segment, a first terminal of the first wire segment serves as the first port of the primary coil, a second terminal of the first wire segment is connected to a first terminal of the fourth wire segment through a first through silicon via, a second terminal of the fourth wire segment is connected to a first terminal of the second wire segment through a second through silicon via, a second terminal of the second wire segment is connected to a first terminal of the fifth wire segment through a third through silicon via, and a second terminal of the fifth wire segment is connected to a first terminal of the third wire segment through a fourth through silicon via; and wherein the third partial path comprises a sixth wire segment, a seventh wire segment and an eighth wire segment, the fourth partial path comprises a ninth wire segment and a tenth wire segment, a first terminal of the sixth wire segment serves as the second port of the primary coil, a second terminal of the sixth wire segment is connected to a first terminal of the ninth wire segment through a fifth through silicon via, a second terminal of the ninth wire segment is connected to a first terminal of the seventh wire segment through a sixth through silicon via, a second terminal of the seventh wire segment is connected to a first terminal of the tenth wire segment through a seventh through silicon via, a second terminal of the tenth wire segment is connected to a first terminal of the eighth wire segment through an eighth through silicon via, and a second terminal of the eight wire segment is connected to a second terminal of the third wire segment at the symmetry line.

11. The transformer as claimed in claim 1, wherein the first partial path comprises a first wire segment, a second wire segment, a third wire segment and a fourth wire segment, the second partial path comprises a fifth wire segment, a sixth wire segment and a seventh wire segment, a first terminal of the first wire segment serves as the first port of the primary coil, a second terminal of the first wire segment is connected to a first terminal of the fifth wire segment through a first through silicon via, a second terminal of the fifth wire segment is connected to a first terminal of the second wire segment through a second through silicon via, a second terminal of the second wire segment is connected to a first terminal of the sixth wire segment through a third through silicon via, a second terminal of the sixth wire segment is connected to a first terminal of the third wire segment through a fourth through silicon via, a second terminal of the third wire segment is connected to a first terminal of the seventh wire segment through a fifth through silicon via, and a second terminal of the seventh wire segment is connected to a first terminal of the fourth wire segment through a sixth through silicon via; and wherein the third partial path comprises an eighth wire segment, a ninth wire segment, a tenth wire segment and an eleventh wire segment, the fourth partial path comprises a twelfth wire segment, a thirteenth wire segment and a fourteenth wire segment, a first terminal of the eighth wire segment serves as the second port of the primary coil, a second terminal of the eighth wire segment is connected to a first terminal of the twelfth wire segment through a seventh through silicon via, a second terminal of the twelfth wire segment is connected to a first terminal of the ninth wire segment through an eighth through silicon via, a second terminal of the ninth wire segment is connected to a first terminal of the thirteenth wire segment through a ninth through silicon via, a second terminal of the thirteenth wire segment is connected to a first terminal of the tenth wire segment through a tenth through silicon via, a second terminal of the tenth wire segment is connected to a first terminal of the fourteenth wire segment through an eleventh through silicon via, a second terminal of the fourteenth wire segment is connected to a first terminal of the eleventh wire segment through a twelfth through silicon via, and a second terminal of the eleventh wire segment is connected to a second terminal of the fourth wire segment at the symmetry line.

12. The transformer as claimed in claim 1, wherein the second partial path comprises a first wire segment (912_1), the first partial path comprises a second wire segment, a first terminal of the first wire segment serves as the first port of the primary coil, and a second terminal of the first wire segment is connected to a first terminal of the second wire segment through a first through silicon via; and where the fourth partial path comprises a third wire segment, the third partial path comprises a fourth wire segment, a first terminal of the third wire segment serves as the second port of the primary coil, a second terminal of the third wire segment is connected to a first terminal of the fourth wire segment through a second through silicon via, and a second terminal of the fourth wire segment is connected to a second terminal of the second wire segment.

* * * * *